US006019460A

United States Patent [19]

Ushiogi et al.

[11] Patent Number: 6,019,460

[45] Date of Patent: Feb. 1, 2000

[54] INK JET PRINTER

[75] Inventors: Hitoshi Ushiogi, Mishima; Takuro Ito, Shizuoka-ken, both of Japan

[73] Assignee: Toshiba Tec Kabushiki Kaisha, Tokyo, Japan

[21] Appl. No.: 09/153,820

[22] Filed: Sep. 15, 1998

[30] Foreign Application Priority Data

Sep. 19, 1997 [JP] Japan ..... 9-255708

[51] Int. Cl.[7] ..... B41J 2/175

[52] U.S. Cl. ..... 347/85

[58] Field of Search ..... 347/85, 86, 87, 347/7, 49; 141/18, 346, 383

[56] References Cited

FOREIGN PATENT DOCUMENTS 5-162335 6/1993 Japan .
7-314711 12/1995 Japan .

*Primary Examiner*—N. Le
*Assistant Examiner*—Michael Nghiem
*Attorney, Agent, or Firm*—Frishauf, Holtz, Goodman, Langer & Chick, P.C.

[57] ABSTRACT

The ink-jet printer includes four ink tanks for detachably supporting four ink reserve bottles filled with inks of different colors and, for storing the inks respectively supplied from the ink reserve bottles, a print head having four nozzle units and connected to receive inks supplied from the ink tanks for printing a color image by ejecting the inks from the nozzle units onto a paper sheet, a lock system for locking each ink reserve bottle attached to a corresponding ink tank to prevent detachment from the corresponding ink tank, and a lock system controller for controlling the lock system. The lock system controller includes a detecting section for detecting which one of the ink reserve bottles has been locked by the lock system, and an unlock section for causing the lock system to unlock any of the ink reserve bottles to be detached from the ink tanks for replacement, in a manner such that ink reserve bottles other than the unlocked one are inhibited from being unlocked until the unlocked ink reserve bottle is replaced by a new ink reserve bottle and the new ink reserve bottle is detected to be locked by the lock system.

5 Claims, 5 Drawing Sheets

INK JET PRINTER

BACKGROUND OF THE INVENTION

The present invention relates to an ink-jet printer which prints an image onto a print medium held on a rotary drum with ink ejected from a print head, and particularly, to an ink-jet printer in which ink is supplied to the print head from an ink tank which receives ink supplemented by an ink reserve bottle detachably attached thereto.

Conventionally, serial-type ink-jet printers are widely spreading. In the serial-type color ink-jet printer, a plurality of print heads and ink tanks of a relatively small capacity are integrally mounted on a carriage, and the carriage is movably attached to a guide bar extending across a paper sheet. The paper sheet is fed in a direction perpendicular to the guide bar at a constant pitch, and the carriage is moved along the guide bar each time the paper sheet is fed for one pitch. During the movement of the carriage, the print heads eject inks of different colors from the ink tanks. In the structure as described above, for example, a color image of A4 size is printed out in ten minutes. Thus, the serial-type color ink-jet printer operates at a slow print speed of 0.1 sheet per minute.

In recent years, a drum rotation type ink-jet printer capable of printing a color image at a higher speed has been suggested. This ink-jet printer includes a rotary drum rotating in one direction and a print head disposed to face a paper sheet held on the rotary drum. The print head includes a plurality of nozzle units which are arranged along the peripheral surface of the rotary drum and eject inks of different colors onto the paper sheet rotating together with the rotary drum. Each nozzle unit includes a plurality of ink-jet nozzles disposed across the paper sheet in the axial direction of the rotary drum. The color image is printed with inks ejected from the nozzle units. In this structure, the color image, for example, of A4 size can be printed out in about two or three seconds.

In this drum-rotation type ink-jet printer, a plurality of ink tanks are placed apart from the print head to store inks of different colors to be supplied to the nozzle units of the print head. Each ink tank is formed to have a structure capable of supporting an ink reserve bottle which is filled with reserve ink of a corresponding color and attached to a top portion of the ink tank. Upon attachment of the ink reserve bottle to the ink tank, ink is supplied to the ink tank from the ink reserve bottle, and the supply of ink is continued until the liquid surface of ink reaches a predetermined height in the ink tank.

However, in the drum-rotation type ink-jet printer, for example, if a user repeatedly attaches and detaches the ink reserve bottle to and from the ink tank to check the remaining amount of ink or to move the printer, ink is excessively supplied to the ink tank from the ink reserve bottle, so that the liquid surface of ink is temporarily raised beyond a predetermined height. The liquid surface of the ink is returned to the predetermined height by discharging such excessive ink from the ink tank as overflow ink. If ink is thus wastefully discharged, the number of paper sheets which can be printed out is greatly reduced with respect to the capacity of ink of one ink reserve bottle.

In addition, when ink reserve bottles are attached to ink tanks of all colors corresponding to reserve inks, there is a possibility that reserve ink of an ink reserve bottle is supplied to a wrong ink tank not corresponding to the color of the reserve ink due to an attachment error of the ink reserve bottles. In this state, a proper color image cannot be obtained at the time of printing, and it is necessary to perform a cleaning for removing ink which has flowed into the print head, the ink tank, and the piping member.

BRIEF SUMMARY OF THE INVENTION

An object of the present invention is to provide an ink-jet printer which can prevent an ink reserve bottle from being erroneously attached to a wrong ink tank not corresponding to the ink reserve bottle.

According to the present invention, there is provided an ink-jet printer which comprises: a plurality of ink tanks for supporting a plurality of ink reserve bottles filled with inks of different colors and detachably attached thereto and for storing the inks respectively supplied from the ink reserve bottles; a print head having a plurality of nozzle units and connected to receive inks supplied from the plurality of ink tanks, for printing a color image by ejecting the inks from the plurality of nozzle units onto a print medium; a lock system for locking each ink reserve bottle attached to a corresponding ink tank to prevent detachment from the corresponding ink tank; and a lock system controller for controlling the lock system; wherein the lock system controller includes a detecting section for detecting which one of the ink reserve bottles has been locked by the lock system, and an unlock section for causing the lock system to unlock any of the ink reserve bottles to be detached from the ink tanks for replacement, in a manner that ink reserve bottles other than the unlocked one is inhibited from being unlocked until the unlocked ink reserve bottle is replaced by a new ink reserve bottle and the new ink reserve bottle is detected to be locked by the lock system.

In the ink-jet printer, the detecting section of the lock system controller detects which one of the ink reserve bottles has been locked. The unlock section causes the lock system to unlock any of the ink reserve bottles to be detached from the ink tanks for replacement, in a manner that ink reserve bottles other than the unlocked one are inhibited from being unlocked until the unlocked ink reserve bottle is replaced by a new ink reserve bottle and the new ink reserve bottle is detected to be locked by the lock system. In this case, empty ink reserve bottles cannot be replaced by new ink reserve bottles filled with inks, without being detached one by one from the ink tanks. This forces a user to carry out a careful operation of replacement without forgetting confirmation of an ink color of the detached bottle or mistaking the ink color. Therefore, each new ink reserve bottle can be effectively prevented from being attached to a wrong ink tank which does not correspond to the ink color of the new ink reserve bottle. In addition, attachment and detachment of the ink reserve bottles are restricted by the lock system to reduce the number of opportunities that ink is excessively supplemented by each ink reserve bottle. Thus, it is possible to avoid wasteful ink consumption caused by discharging the excessive ink from the ink tanks.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to an embodiment of the present invention will be described with reference to FIGS. 1 to 5.

Figure 1:
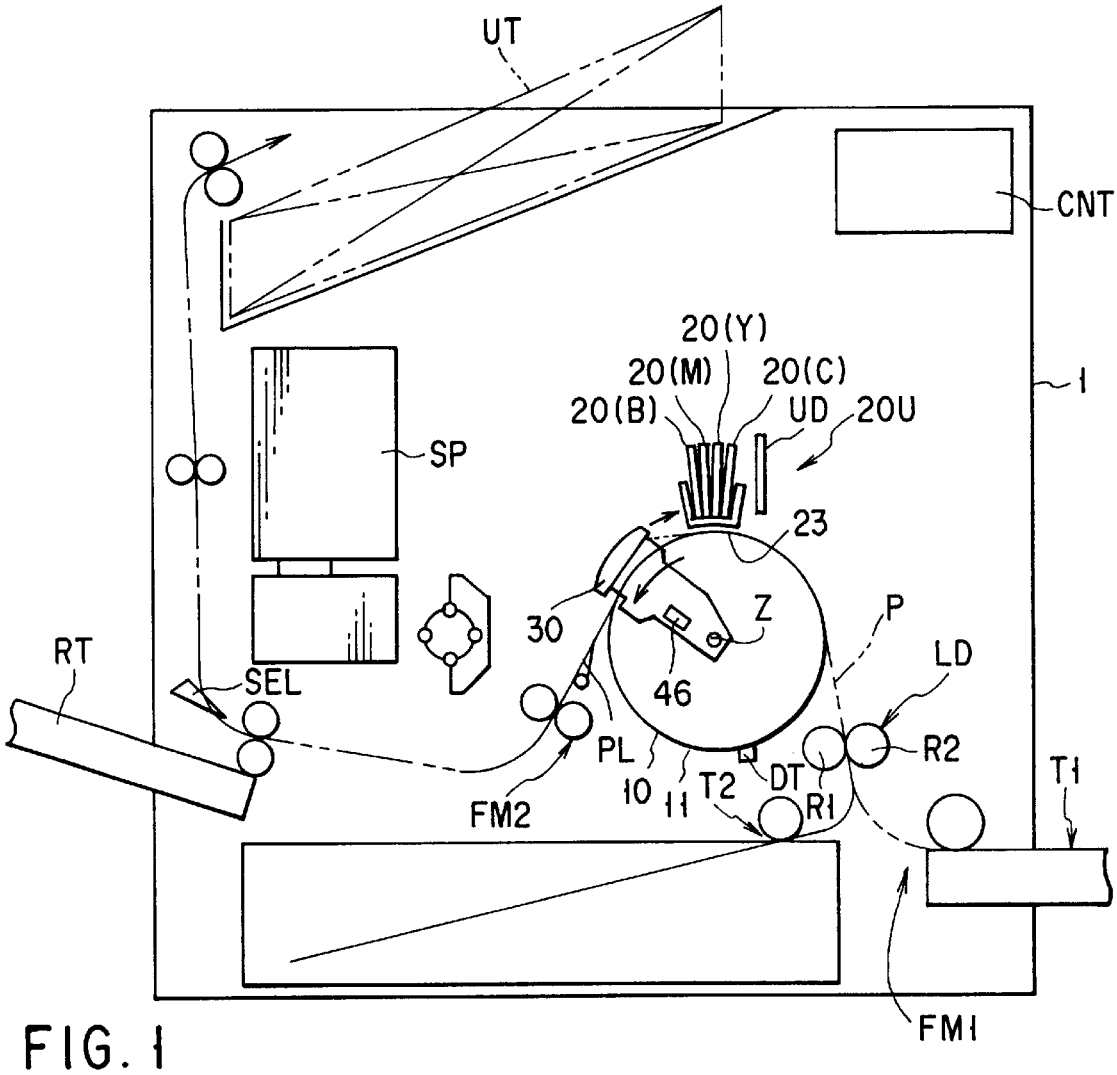
FIG. 1 is a view showing an internal structure of an ink-jet printer according to an embodiment of the present invention.

FIG. 1 shows an internal structure of the ink-jet printer. The ink-jet printer is used to perform a multicolor printing on a paper sheet P cut as a printing medium. The paper sheet P may be a plain paper or OHP sheet.

The ink-jet printer comprises a rotary drum 10, a print head 20U, a manual-feed tray T1, a paper cassette T2, sheet feed-in mechanism FM1, a sheet feed-out mechanism FM2, and a control unit CNT. The rotary drum 10 rotates at a predetermined circumferential speed, with a paper sheet held thereon. The print head 20U performs a multicolor printing on the paper sheet P rotating along with the rotary drum 10. The manual-feed tray T1 receives each of paper sheets to be fed one by one. The paper cassette T2 contains a stack of paper sheets P. The sheet feed-in mechanism FM1 feeds each paper sheet from the paper cassette T2 and manual-feed tray T1 into the rotary drum 10. The sheet feed-out mechanism FM2 feeds out the paper sheet P printed at the rotary drum 10. The control unit CNT controls the overall operation made by the components of the ink jet printer. As shown in FIG. 1, the rotary drum 10 is located near the central position within a housing 1. The manual-feed tray T1 is located below the rotary drum 10 and extends externally from a front surface of the housing 1, and the paper cassette T2 is located under the manual-feed tray 10. The sheet feed-in mechanism FM1 is placed between the manual-feed tray T1 and the paper cassette T2. The print head 20U is located above the rotary drum 10. The sheet feed-out mechanism FM2 is located on a side of the rotary drum 10 which is opposite to the sheet feed-in mechanism FM1.

Figure 2:
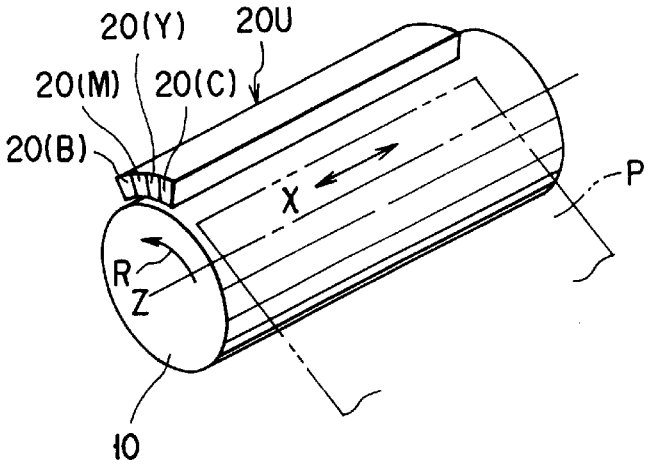
FIG. 2 is a perspective view showing a positional relationship between the rotary drum and the print head shown in FIG. 1.

The rotary drum 10 is supported to be rotatable about the axis Z, and causes the paper sheet P wound around and held on a peripheral surface 11 thereof in accordance with its rotation indicated by an arrow in FIG. 2. The rotational position of the rotary drum 10 is detected by a rotational position detector DT disposed near the peripheral surface 11 of the rotary drum 10. The print head 20U includes four nozzle units 20 (C, Y, M, and B) which are arranged in order along the peripheral surface 11 of the rotary drum 10 from the upstream side to the downstream side so as to perform a printing on the paper sheet P with inks of cyan (C), yellow (Y), magenta (M), and black (B). The nozzles units 20 (C, Y, M, and B) receive inks of corresponding colors from an ink supply system SP. Each of the nozzle units 20 (C, Y, M, and B) has a plurality of ink-jet nozzles 23 which are arranged in the axial direction of the rotary drum 10 to have a span corresponding to the width of the paper sheet P of A4 size and eject the corresponding color ink to the paper sheet P. Specifically, the nozzle units 20 (C, Y, M, and B) are constructed in structures identical to each other. Each of the nozzle units 20 (C, Y, M, and B) has four nozzle segments 20A to 20D arrayed in a zigzag form on a connection plate (not shown) extending in the axial direction X of the rotary drum 10 which coincides with to the widthwise direction of the paper sheet P. The nozzle segments 20A and 20C are mounted on a first surface of the connection plate, and the nozzle segments 20B and 20C are mounted on a second surface of the connection plate opposed to the first surface. The top ends of the ink-jet nozzles 23 of the nozzle segments 20A to 20D are aligned with a height equal to the level of the top end surface 24 of the print head 20U. Each of the nozzle segments 20A to 20D is constituted by a predetermined number of ink-jet nozzles 23 and an ink pressure chamber 22 for directly applying ink to the ink-jet nozzles 23. The ink pressure chambers 22 of the nozzle segments 20A to 20D are connected in series such that ink flow through the chambers 22. The pitch PT of the ink-jet nozzles 23 is set to 1/150, for example, in the case where the printing resolution is 300 dpi in the main scanning direction X.

The sheet feed-in mechanism FM1 has a sheet loader LD for loading the paper sheet P to the rotary drum 10 such that the width direction of the paper sheet P coincides with the axial direction of the rotary drum 10. The paper sheet P is taken out of either the manual-feed tray T1 or the paper cassette T2. The paper loader LD is controlled to load the paper sheet P toward the rotary drum 10 when the position detector DT detects that the rotary drum 10 has been rotated to a predetermined position. The print head 20Y prints a color image on the paper sheet P as the rotary drum 10 rotates.

The paper sheet P is removed from the peripheral surface 11 of the rotary drum 10 by a sheet separator PL and fed in a predetermined direction by the sheet feed-out mechanism FM2. The paper separator PL is a separation claw which is brought into contact with the rotary drum 10 at the time of sheet removal. A discharge switch SEL guides the paper sheet P to a selected one of a rear discharge tray RT and an upper discharge tray UT. The print surface of the paper sheet P faces upward on the rear discharge tray RT, and faces downward on the upper discharge tray UT.

The print head 20U is capable of being reciprocally shifted by 1/75 inch in the main scanning direction X parallel to the axial direction of the rotary drum 10. The rotary drum 10 holds the paper sheet P wound around and held on the peripheral surface 11, and rotates to move the paper sheet P in a subscanning direction Y perpendicular to the main scanning direction X, with the paper sheet P opposing to the nozzle units 20 (C, Y, M, and B). The rotary drum is maintained at a constant rotation rate of 120 rpm and makes one rotation every 0.5 second, for example. In the printing operation, the print head 20U is shifted in the main scanning direction X at a constant rate of ½ nozzle pitch PT each time the rotary drum makes one rotation, so that it moves for a distance equal to the nozzle pitch PT while the rotary drum 10 makes two rotations.

The paper loader LD includes at least a pair of loading rollers R1 and R2 extending in the axial direction of the drum to load the paper sheet P fed from the manual-feed tray T1 or paper cassette T2 to the rotary drum 10 at a predetermined timing. The feed speed of the paper sheet P is set to a value corresponding to the circumferential speed of the rotary drum. Since the diameter of the rotary drum 10 is 130 mm, a circumferential speed of 816 mm/sec can be obtained. The peripheral surface 11 of the rotary drum 10 is about 220 mm wide in the axial direction and 408 mm long in the rotational direction. Therefore, the rotary drum 10 can fully hold the A4 size paper sheet P having a length of 297 mm and a width of 210 mm.

Figure 3:
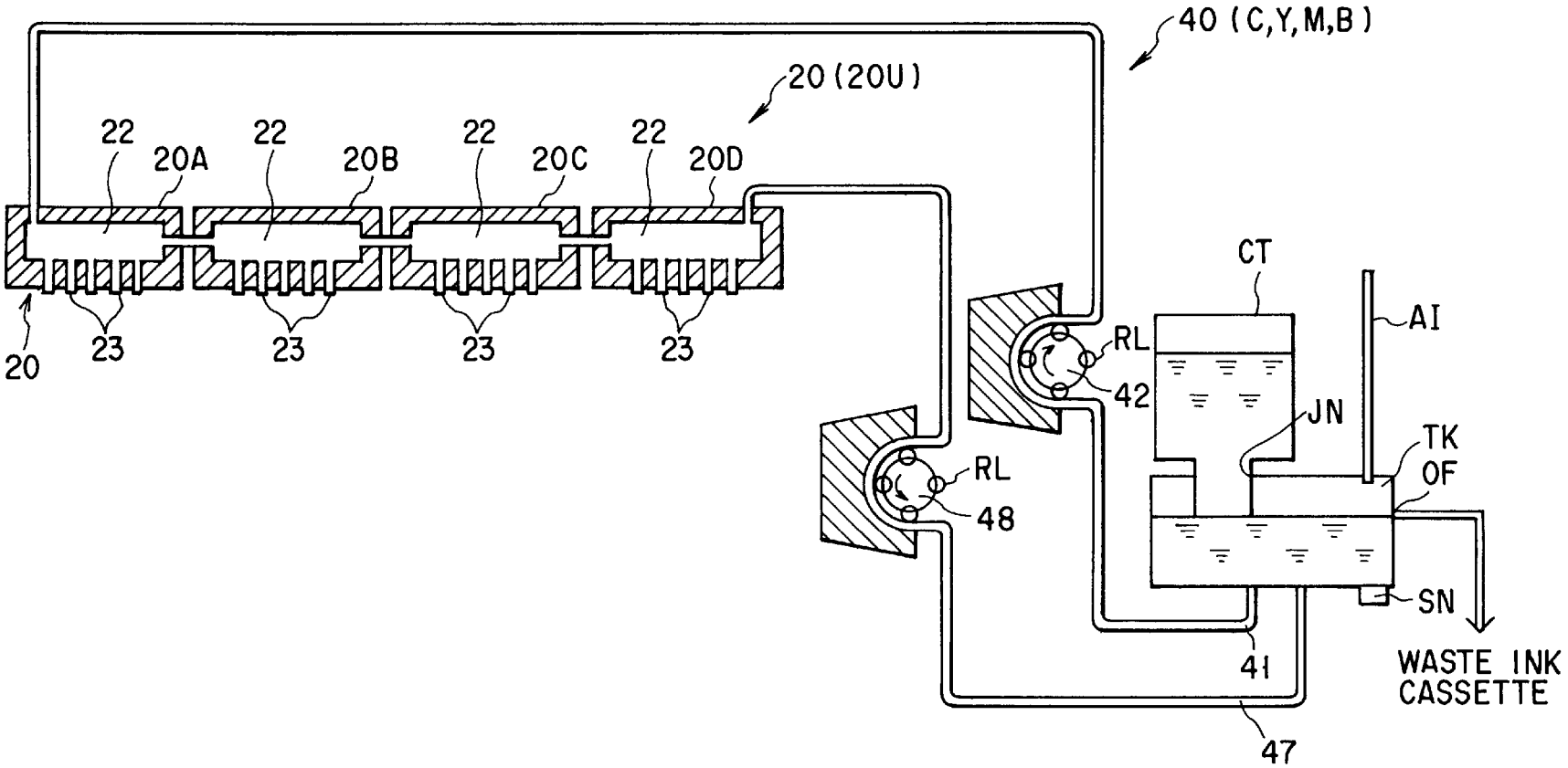
FIG. 3 is a cross-sectional view of an ink supply system incorporated in the ink-jet printer shown in FIG. 1.
Figure 4:
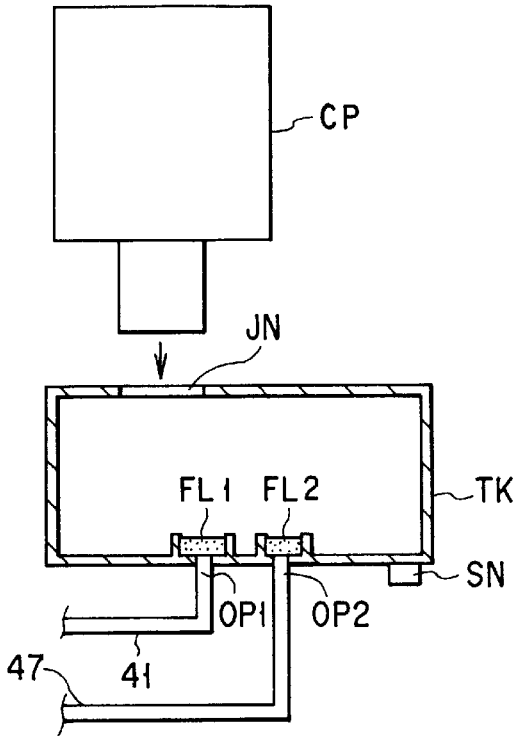
FIG. 4 is a view showing a state where an ink reserve bottle is attached to the ink tank shown in FIG. 3.
Figure 5:
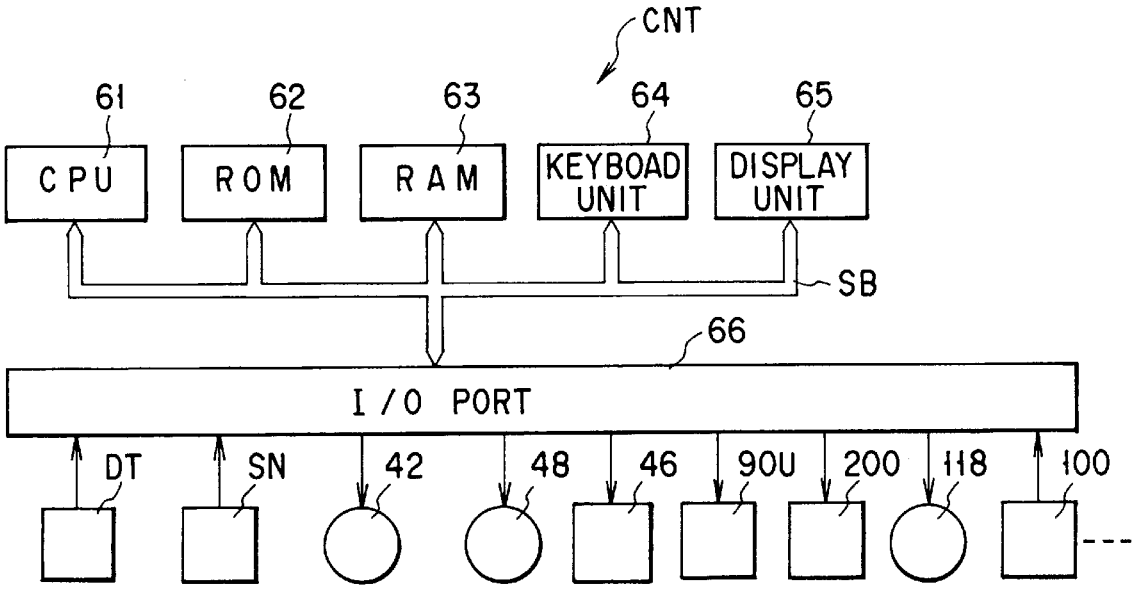
FIG. 5 is a block diagram for explaining a control unit shown in FIG. 1.

The ink supply system SP includes ink supply sections 40 for nozzle units 20 (C, Y, M, and B), respectively. As shown in FIG. 3, each ink supply section 40 includes an ink tank TK which is disposed apart from the print head 20U and stores ink, an ink reserve bottle CT for supplying ink to the ink tank TK, an ink supply tube 41 for guiding ink from the ink tank TK to the nozzle unit 20, and an ink return tube 47 for guiding ink from the nozzle unit 20 to the ink tank TK. The ink supply section 40 further includes a supply pump 42 interposed in the ink supply tube 41, a return pump 48 interposed in the ink return tube 47, and an ink amount detection sensor SN attached to the ink tank TK. The supply pump 42 performs an ink supply operation of flowing ink from the ink tank TK to the nozzle unit 20 through the ink supply tube 41. The return pump 48 performs an ink suction operation of flowing excessive ink from the nozzle unit 20 to the ink tank TK through the ink return tube 48. The ink amount detection sensor SN detects an amount of ink stored in the ink tank TK.

Each of the ink supply tube 41 and ink return tube 47 is constituted by an elastic tube of soft synthetic resin. Each of the supply pump 42 and return pump 48 is of a rotary type in which four press rollers RL are provided at a predetermined interval on a circular locus. Each pump has a valve function in which the press rollers RL are stopped to set the elastic tube to a selected one of open and closed states, and are rotated to forcibly flow ink with pressure. Ink is circulated between the ink tank TK and the nozzle unit 20 of the print head 20U by simultaneously driving the supply pump 42 and the return pump 48.

The ink tank TK includes a connection port JN for supporting ink reserve bottle CT detachably attached thereto, a supply port OP1 connected to the ink supply tube 41, a return port OP2 connected to the ink return tube 47, an air intake AI formed in communication with the external and internal spaces to take in atmospheric air from the external space to the internal space, and an overflow port OF formed at a predetermined height to drain overflow ink from the ink tank TK. The ink reserve bottle CT has a liquid surface stabilizing mechanism 70 for causing ink to be supplied from the ink reserve bottle when the liquid surface of ink becomes lower than the predetermined height in the ink tank TK, and discharging excessive ink as overflowing ink through the overflow port OF when the liquid surface is raised beyond the predetermined height. The ports OP1 and OP2 are respectively covered with filters FL1 and FL2 for filtering ink to remove impurities contained therein.

The ink-jet printer further includes an elevation mechanism UD for automatically adjusting the height of the print head 20U shown in FIG. 1, an ink collection tray 30 for collecting ink ejected from the print head 20U during a non-printing time, and a rotating mechanism 46 for rotating the ink collection tray 30 along the peripheral surface 11 of the rotary drum 10 such that the ink collection tray 30 can face the print head 20U. At the time of printing, the elevation mechanism UD moves the print head 20U to a lower limit position close to the rotary drum 10. At the time of non-printing, the elevation mechanism UD moves the print head 20U to an upper limit position apart from the rotary drum 10, and then to an ink discharge position located between the upper and lower limit positions. At the non-printing time, the rotating mechanism 46 rotates the ink collection tray 30 in a state where the print head 20U is set at the upper limit position, so that the ink collection tray 30 is inserted between the print head 20U and the rotary drum 10. The print head 20U is set to the ink discharge position after insertion of the ink collection tray 30. In this manner, the top ends of the nozzle units 20 (C, Y, M, and B) are set close to the ink collection tray 30 without making contact with the tray 30, so that the ink collection tray 30 can be used in common to collect inks ejected from the nozzle units 20 (C, Y, M, and B) of the print head 20U. Collected ink is drained as waste ink to a detachable waste ink cassette (not shown) from a discharge port of the ink collection tray 30 and is then disposed of.

The control unit CNT includes a CPU 61 for performing a control processing for printing and maintenance, a ROM 62 for storing a control program for the CPU 61, a RAM 63 for temporarily storing data items input into and output from the CPU 61, a display unit 65 for displaying the status of the ink-jet printer, a keyboard unit 64 for entering various mode settings, and an input and output port (or I/O port) 66 serving as an interface for external components of the control unit CNT. The CPU 61 is connected to the ROM 62, RAM 63, keyboard unit 64, display unit 65, and I/O port 66 through a system bus SB. The I/O port 66 is connected to the print head 20U, rotational position detector DT, ink amount detection sensor SN, supply pump 42, return pump 48, elevation mechanism UD, rotating mechanism 46, and other components.

Figure 9:
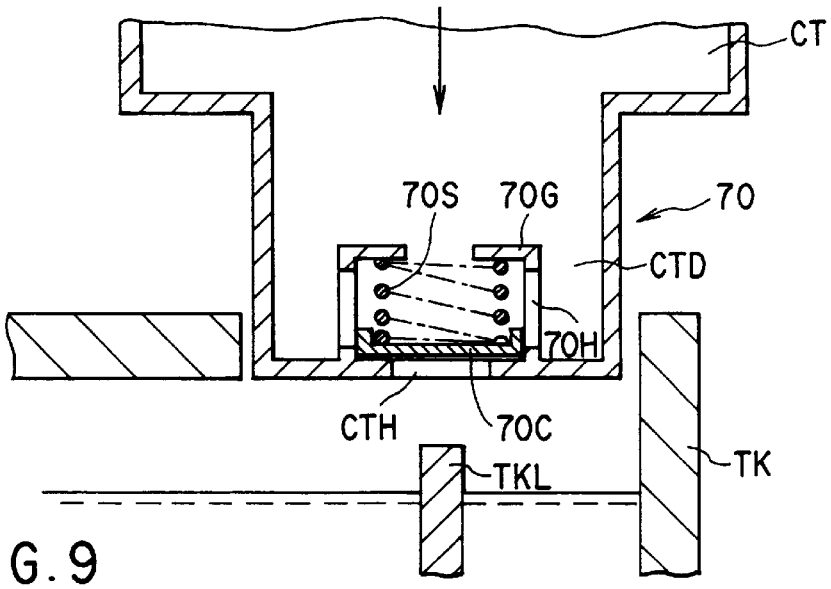
FIG. 9 is a view for explaining a liquid surface stabilizing mechanism.

The structure of the liquid surface stabilizing mechanism 70 will now be explained in detail. As shown in FIG. 9, the liquid surface stabilizing mechanism 70 includes a cap guide 70G formed at a lower portion CTD of the ink reserve bottle CT inside an ink supply port CTH, a cap 70C received in the cap guide 70G, a spring 70S received in the cap guide 70G, for pressing downward the cap 70C to close the ink supply port CTH, and a projection TKL disposed at a position below the connection port JN in the ink tank TK. When the ink reserve bottle CT is completed to be attached to the connection port JN, the supply port CTH is set to the predetermined height equal to the level of the lower part of the overflow port OF in the ink tank TK. Upon attachment of the ink reserve bottle CT, the top end of the projection TKL opens the ink supply port CTH by entering into the cap guide 70G through the supply port CTH and pushing up the cap 70C against an urging force from the spring 70S. At this time, ink is taken in into a flow-in port 70H of the cap guide 70G in the ink reserve bottle CT, and flows down into the ink tank TK through the ink supply port CTH. This flow of ink stops when the liquid surface of ink rises to the height of the ink supply port CTH in the ink tank TK, and is restarted when the liquid surface of ink drops to be lower than the ink supply port CTH. In a case where the liquid surface of ink temporarily becomes higher than the predetermined height, excessive ink is drained to the waste ink cassette from the overflow port OF. Thus, the liquid surface of ink is stabilized to be kept at the predetermined height in the ink tank TK.

Figure 6:
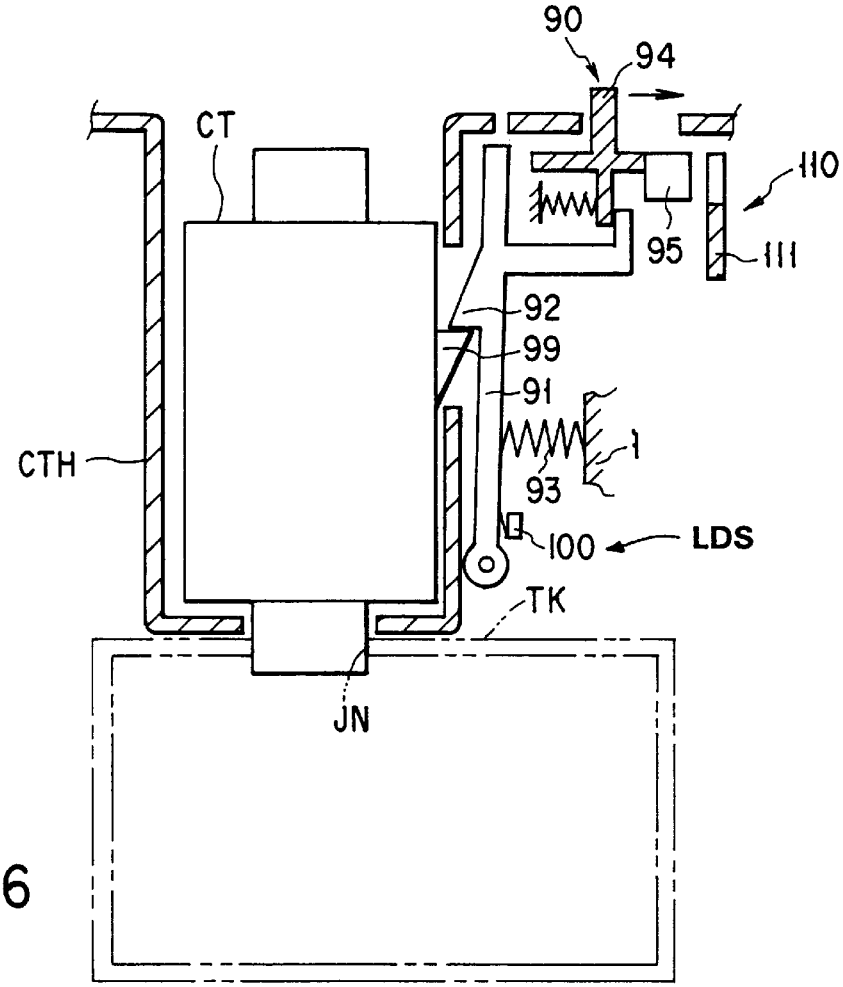
FIG. 6 is a cross-sectional view showing a lock mechanism for locking the ink reserve bottle such that the bottle is kept engaged with the ink tank shown in FIG. 3.

The ink-jet printer further includes a lock system which locks the ink reserve bottle CT of each color upon attachment thereof to prevent the ink reserve bottle CT from being detached from a corresponding ink tank TK, and a lock system controller for controlling the lock system. The lock system includes four lock mechanisms 90 (C, Y, M, and B) which are respectively provided for the ink supply sections 40 (C, Y, M, and B) for cyan, yellow, magenta, and black to lock the ink reserve bottles CT each attached to the connection port JN by the guide member CTH, as shown in FIG. 6. The lock system controller includes a lock detecting section LDS for detecting which one of the four ink cassettes CT has been locked, and an unlock section 110. To perform replacements of the four ink reserve bottles CT attached to the four ink tanks TK in a predetermined order, the unlock section 110 causes the lock system to unlock the four ink reserve bottles CT one by one, in a manner such that ink reserve bottles CT other than an unlocked ink reserve bottle CT are inhibited from being unlocked until the unlocked ink reserve bottle CT is replaced by a new ink reserve bottle CT and the new ink reserve bottle CT is detected to be locked by the lock system. The lock detecting section LDS includes four lock detectors 100 which are respectively provided for the ink supply sections 40 (C, Y, M, and B), and each of which detects that an ink reserve bottles CT is locked so as not to be detached from a corresponding ink tank TK. The lock detecting section LDS is indicated in FIG. 6, which is a cross-sectional view in which one of the four lock detectors 100 is shown. The unlock section 110 is provided in common for the ink supply sections 40 (C, Y, M, and B).

In each of the ink supply sections 40 (C, Y, M, and B), the lock mechanism 90 includes an engaging portion 99 projecting from the side surface of the ink reserve bottle CT, a lock lever 91 which has a lock portion 92 to be engaged with the engaging portion 99 and is supported by a stationary body such as a housing 1 or the like to be pivotal about its proximal end, a spring member 93 for energizing the lock lever 91 such that the lock portion 92 of the lock lever 91 is set to an engagement position, and an operation lever 94 which is slid by manual operation against the energizing force of the spring member 93 in order to move the lock lever 91 such that the lock portion 92 is set apart from the engagement position. When an ink reserve bottle CT is attached to the connection port JN of the ink tank TK, the engaging portion 99 slides in contact with the lock portion 92 of the lock lever 91 and moves downward pushing back the lock portion 92 against the energizing force of the spring member 93. Once the engaging portion 99 is engaged with the lock portion 92, the ink reserve bottle CT is not moved upward in an attempt to detach the bottle CT from the ink tank TK. As the operation lever 94 is slid in the arrow direction shown in FIG. 6, the operation lever 94 is engaged with the upper end portion of the lock lever 91 and moves the lock lever 91, so that the engagement between the lock portion 92 of the lock lever 91 and the engaging portion 99 of the ink reserve bottle CT is released. The lock detector 100 detects that the ink reserve bottle CT is locked by the lock mechanism 90, based on rotation of the lock lever 91 when the engaging portion 99 of the ink reserve bottle CT attached to the connection port JN of the ink tank TK pushes back the lock portion 92 against the energizing force of the spring member 93.

Figure 7:
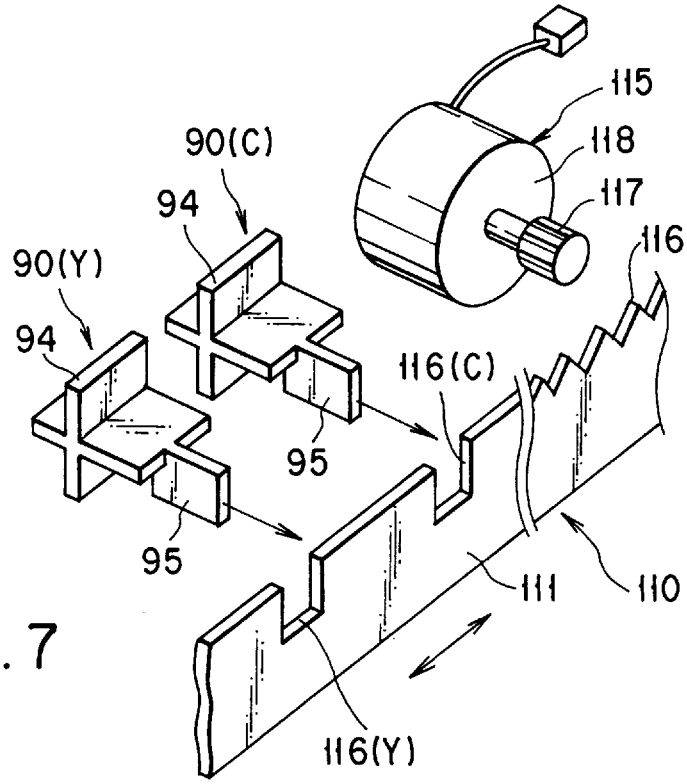
FIG. 7 is a perspective view for explaining a detachment operation lever and a slider lock plate shown in FIG. 6.
Figure 8:
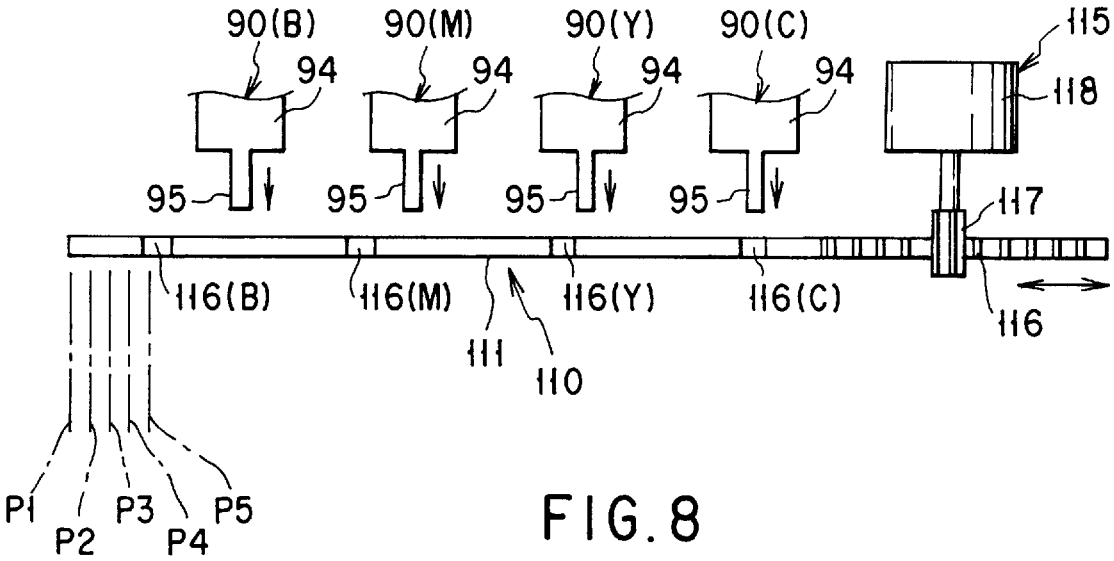
FIG. 8 is a view for explaining a positioning control of the slider lock plate shown in FIG. 6.

As shown in FIGS. 7 and 8, the unlock section 110 includes a slider lock plate 111 which selectively restricts sliding of the operation lever 94, and a position updating section 115 which moves the slider lock plate 111 to be selectively set at positions P1 to P5 which are distant from each other by a predetermined pitch. The position updating section 115 includes a rack portion 116 formed to be integral with the slider lock plate 111, a pinion 117 engaged with the rack portion 116, and a drive motor 118 for rotating the pinion 117. The drive motor 118 is driven under a control of the CPU 61 in the control unit CNT. The CPU 61 performs a processing of controlling the drive motor 118, based on signals from the ink amount detection sensors SN and lock detectors 100, which are incorporated in the four ink supply sections 40.

The slider lock plate 111 has notch portions 116 (C, Y, M, and B) into which engaging projections 95 of the operation levers 94 for cyan (C), yellow (Y), magenta (M), and black (B) are respectively inserted. The notch portions 116 are previously set in a positional relationship such that the engaging projections 95 can be sequentially inserted into corresponding ones of the notch portions 116 (C, Y, M, and B) as the slider lock plate 111 moves.

When the slider lock plate 111 is positioned at the position P1, the engaging projection 95 of the operation levers 94 for cyan (C) opposes to a notch portion 116 (C), and the other engaging projections 95 are set in positions in which the engaging projections do not oppose to any of the notch portions 116 (C, Y, M, and B). Specifically, only the engaging projection 95 of the operation lever 94 for cyan (C) can be inserted to the notch portion 116 (C).

When the slider lock plate 111 is positioned at the position P2, it becomes into a state where the engaging projection 95 of the operation lever 94 for yellow (Y) opposes to a notch portion 116 (Y), and the other engaging projections 95 do not oppose to any of the notch portions 116 (C, Y, M, and B). Specifically, only the engaging projection 95 of the operation lever 94 for yellow (Y) can be inserted to the notch portion 116 (Y).

When the slider lock plate 111 is positioned at the position P3, it becomes a state where the engaging projection 95 of the operation lever 94 for magenta (M) opposes to a notch 116 (M), and the other engaging projections 95 do not oppose to any of the notch portions 116 (C, Y, M, and B). Specifically, only the engaging projection 95 of the operation lever 94 for magenta (M) can be inserted to the notch portion 116 (M).

When the slider lock plate 111 is positioned at the position P4, it becomes a state where the engaging projection 95 of the operation lever 94 for black (B) opposes to a notch portion 116 (B), and the other engaging projections 95 do not oppose to any of the notch portions 116 (C, Y, M, and B). Specifically, only the engaging projection 95 of the operation lever 94 for black (B) can be inserted to the notch portion 116 (B).

When the slider lock plate 111 is positioned at the position P5, it becomes a state where the engaging projections 95 of the operation levers for all the colors do not oppose to any of the notch portions 116 (C, Y, M, and B). Specifically, the engaging projections 95 of all the operation levers 94 cannot be inserted in any of the notch portions. The unlock section 110 is kept waiting in a state where the slider lock plate 111 is set at the position P5.

In the processing of controlling the drive motor 118, when it is recognized that any of four ink tanks TK has become nearly empty, based on output signals from the ink amount detection sensors SN respectively attached to the ink tanks TK, the position of the slider lock plate 111 is changed to one of the positions P1 to P4 which corresponds to the ink tank TK which has become nearly empty, and the lock mechanism 90 which locks the ink reserve bottle CT for the ink tank TK is allowed to be unlocked. In addition, when it is recognized that two or more ink tanks TK have come nearly empty, the position of the slider lock plate 111 is changed to one of the positions P1 to P4 which corresponds to one of the ink tanks TK which have become nearly empty, by driving the drive motor 118, and the lock mechanism 90 which locks the ink reserve bottle CT for the ink tank TK is allowed to be unlocked. Thereafter, the drive motor 118 is not driven until it is recognized, base on an output signal from a corresponding lock detector 100, that a new ink reserve bottle CT to be attached in place of the ink reserve bottle CT thus unlocked has been locked by the lock mechanism 90. That is, the ink reserve bottles corresponding to the other one or more ink tanks TK which have become nearly empty are inhibited from being unlocked. After it is recognized, by an output signal from a corresponding lock detector 100, that the new ink reserve bottle has been locked, the position of the slider lock plate 111 is changed to another one of the positions P1 to P4 which corresponds to another one of the ink tanks TK which have become nearly empty, and the lock mechanism which locks the ink reserve bottle CT for the ink tank TK is allowed to be unlocked. If there is further another ink tank TK which has become nearly empty, the unlock operation as described above is repeated in a similar manner.

For example, if it is recognized, by output signals from four ink amount detection sensors SN, that all the ink tanks TK have come nearly empty, the position of the slider lock plate 111 is changed in an order of P1, P2, P3, P4, and P5. The ink cassette CT for cyan (C) is allowed to be unlocked when the slider lock plate 111 is positioned at the position P1. After replacement of the ink reserve bottle CT, the slider lock plate 111 is moved to the position P2 on condition that the lock detector 100 for the lock mechanism 90 (C) detects that a new ink reserve bottle CT has been locked by the lock mechanism 90 (C). The ink reserve bottle CT for yellow (Y) is then allowed to be unlocked. After replacement of the ink reserve bottle CT for yellow (Y), the slider lock plate 111 is moved to the position P3 on condition that the lock detector 100 for the lock mechanism 90 (Y) detects that a new ink reserve bottle CT has been locked by the lock mechanism 90 (Y). The ink reserve bottle CT for magenta (M) is then allowed to be unlocked. After replacement of the ink reserve bottle CT for magenta (M), the slider lock plate 111 is moved to the position P4 on condition that the lock detector 100 for the lock mechanism 90 (M) detects that a new ink reserve bottle CT has been locked by the lock mechanism 90 (M). The ink reserve bottle CT for black (B) is then allowed to be unlocked. After replacement of the ink reserve bottle CT for black (B), the slider lock plate 111 is moved to the position P5 on condition that the lock detector 100 for the lock mechanism 90 (B) detects that a new ink reserve bottle CT has been locked by the lock mechanism 90 (B). All of the ink reserve bottles CT are then inhibited again from being unlocked.

In the ink-jet printer described above, for example, after the ink reserve bottle CT for each color is attached to the ink tanks TK corresponding to the color and is locked by the lock mechanism 90, the ink reserve bottle CT is not allowed to be unlocked until it is recognized, by the output signal from the corresponding ink amount detection sensor SN, that the ink tank TK has become nearly empty. That is, since attachment and detachment of the ink reserve bottles CT are restricted, it is possible to avoid wasteful ink consumption of discharging unused ink into waste ink cassette due to repetition of attachment and detachment of the ink reserve bottle CT.

In addition, if it is necessary to replace all the ink reserve bottles CT, the ink reserve bottles CT can be replaced one by one in a predetermined order of, for example, cyan (C), yellow (Y), magenta (M), and black (B). That is, the lock mechanisms 90 (C, Y, M, and B) continue locking the ink reserve bottles CT except for one. Therefore, a user must detach one after another of empty ink reserve bottles CT and replace them one after another with new ink reserve bottles filled with inks. As a result of this, the user is forced to carry out a careful replacement operation without forgetting confirmation of an ink color of the detached bottle or mistaking the ink color. Therefore, each new ink reserve bottle can be effectively prevented from being attached to a wrong ink tank which does not correspond to the ink color of the new ink reserve bottle.

Further, incorrect attachment of the ink reserve bottles CT can be more securely prevented, if the color of the ink reserve bottle CT to be replaced is indicated on the display unit 65 and the lock mechanism 90 is allowed to unlock the ink reserve bottle CT of the color when the residual amount of ink in each ink tank TK becomes very small.

In the embodiment described above, four notch portions 116 are respectively used so as to correspond to the engaging projections 95 of the operation levers 94 for cyan (C), yellow (Y), magenta (M), and black (B). In place of the four notch portions, one single notch portion may be formed on the slider lock plate 111 such that the notch portion is made sequentially oppose to four engaging projections 95 to enable unlocking.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An ink-jet printer comprising:

a plurality of ink reserve bottles containing inks of different colors;

a plurality of ink tanks for detachably supporting the plurality of ink reserve bottles and for storing the inks respectively supplied from said ink reserve bottles;

a print head having a plurality of nozzle units and connected to receive inks supplied from said plurality of ink tanks for printing a color image by ejecting the inks from said plurality of nozzle units onto a print medium;

a lock system for individually locking each ink reserve bottle to a corresponding one of the ink tanks to prevent detachment from the corresponding one of the ink tanks; and a lock system controller for controlling said lock system, said lock system controller including: (i) a detecting section for detecting which one of said ink reserve bottles has been locked by said lock system, and (ii) an unlock section for causing said lock system to unlock any of said ink reserve bottles to be detached from said ink tanks for replacement, and for causing all of the ink reserve bottles other than an unlocked one to be inhibited from being unlocked until the unlocked ink reserve bottle is replaced by a new ink reserve bottle and the new ink reserve bottle is detected to be locked by said lock system.

2. An ink-jet printer according to claim 1, wherein said lock system includes a plurality of lock mechanisms for respectively locking said plurality of ink reserve bottles so as not to be detachable from said plurality of ink tanks, and said detecting section includes a plurality of lock detectors for detecting locking operation of said plurality of lock mechanisms.

3. An ink-jet printer according to claim 2, wherein each of said lock mechanisms includes a lock member to be locked on a corresponding one of the ink reserve bottles, and a slide member which is slidable to move said lock member to be detached from the corresponding one of the ink reserve bottles.

4. An ink-jet printer according to claim 3, wherein said unlock section includes a slide stopper mechanism for disabling slide operations of all of the slide members except for one of said slide members which is kept operable to unlock one of said ink reserve bottles locked by said lock members of said lock mechanisms.

5. An ink-jet printer according to claim 4, wherein said slide stopper mechanism includes a plate member having at least one notch portion, and a position updating section for causing a position of said plate member to be moved with respect to said slide members of said lock mechanisms.

* * * * *

UNITED STATES PATENT AND TRADEMARK OFFICE

CERTIFICATE OF CORRECTION

PATENT NO. : 6,019,460
DATED : February 1, 2000
INVENTOR(S) : Hitoshi Ushiogi et al.

It is certified that error appears in the above-identified patent and that said Letters Patent is hereby corrected as shown below:

Title page,
Item [56] References Cited, insert -- U.S. PATENT DOCUMENTS 5,777,646 7/1998 Barinaga et al 347/86 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*